US005542662A

United States Patent [19]

Kouzai et al.

[11] Patent Number: 5,542,662

[45] Date of Patent: Aug. 6, 1996

[54] SPORTS BALL AND PRODUCTION METHOD THEREOF

[75] Inventors: Keiji Kouzai; Junichi Tanaka, both of Koshigaya, Japan

[73] Assignee: Tachikara Co., Ltd., Tokyo, Japan

[21] Appl. No.: 355,707

[22] Filed: Dec. 14, 1994

[30] Foreign Application Priority Data

Dec. 28, 1993 [JP] Japan ..... 5-354205

[51] Int. Cl.[6] ..... A63B 41/08

[52] U.S. Cl. ..... 273/58 BA; 273/58 R; 273/65 B

[58] Field of Search ..... 273/58 BA, 58 R, 273/58 A, 58 B, 58 J, 58 H, 60 R, 60 B, 60 A, 65 R, 65 A, 65 B, 65 E, 65 EB, 65 EC, 65 ED

[56] References Cited

U.S. PATENT DOCUMENTS 4,239,568 12/1980 Takazawa ..... 273/58 BA
4,462,590 7/1984 Mitchell ..... 273/65 E
4,463,951 8/1984 Kumasaka et al. ..... 273/58 BA
4,660,831 4/1987 Kralik ..... 273/65 E

FOREIGN PATENT DOCUMENTS 2504019 10/1982 France ..... 273/58 BA

*Primary Examiner*—Steven B. Wong
*Attorney, Agent, or Firm*—Darby & Darby, P.C.

[57] ABSTRACT

An inflatable tube 1 is inserted into a covering layer 2 formed of a thin rubber pouch which is made of a material which does not permit a solution of an adhesive agent, such as an aqueous solution of latex or a solution of an adhesive agent which contains rubber, used to attach a reinforced layer to the covering layer to pass through said covering layer, and an inorganic lubricant 3 disposed between the tube and the covering layer.

12 Claims, 3 Drawing Sheets

SPORTS BALL AND PRODUCTION METHOD THEREOF

BACKGROUND OF THE INVENTION

The present invention relates to a sports ball; in particular, the invention relates to a sports ball used for such sports as volleyball, basketball, dodgeball, soccer, or handball.

Hitherto, sports balls are produced by two methods. A first type of conventional ball is produced, for example, by pumping air into an inflatable tube and affixing cloth pieces closely on the surface of the tube with latex, or by winding a string around the surface of the tube and fixing the string on the surface with an adhesive agent to form a reinforced layer, followed by the adhesion of the outer layer. A second type of conventional ball is produced by the following steps, for example, as disclosed in a Japanese Patent Application, First publication, Sho 58-29112. Cloth pieces are attached on the surface of an empty globe which consists of brittle material such as paraffin to form a cloth pouch. The globe is removed from the pouch and an inflatable tube is put into the pouch. The tube is filled with air and protruding bars are formed on the alignments which are formed on mutually overlapping cloth pieces. Then, an outer layer is attached on the surface of the pouch along the bars.

The first type of conventional ball has the desirable characteristic of high strength because the tube is protected by a reinforced layer which is located exterior to the tube. The second type of conventional ball has the advantage of durability because a space is provided between an inner surface of the pouch and an outer surface of the tube, so this ball may absorb stresses caused by external forces.

However, the first type of conventional ball is relatively hard and inferior in softness. The second type of conventional ball is superior in softness, although production efficiency is low and it is expensive because it requires complex production steps such as: forming an empty globe consisting of brittle material, attaching cloth pieces on the surface of the globe to form a cloth pouch, and removing the globe from the pouch.

SUMMARY OF THE INVENTION

In view of the above, it is an object of the present invention to provide a sports ball having superior properties such as strength, durability, softness, and elasticity, for use in sports such as volleyball, basketball, dodgeball, soccer, or handball, The present invention also provides a production method for the sports ball, which in particular enables the production of the ball using simple steps and on a large scale.

In the present invention, these objects are realized by providing a sports ball which comprises: a hollow spherically shaped inflatable tube; a covering layer comprising a very thin rubber pouch and covering around the inflatable tube; a reinforced layer which is adhered on the surface of the covering layer with a solution of an adhesive agent; and an outer layer which is formed on the surface of the reinforced layer; wherein, the covering layer is made of a material which does not permit the solution of said adhesive agent to pass through the covering layer, and an inorganic lubricant is disposed between the tube and the covering layer.

The inorganic lubricant is disposed between the tube and the covering, layer by injecting a powder of the inorganic lubricant into the very thin rubber pouch, or by spreading a powder or a suspension of the inorganic lubricant on the surface of the inflatable tube.

Furthermore, the reinforced layer may be formed by attachment of cloth pieces on the surface of the covering layer and fixing cloth pieces on the surface with the solution of adhesive agent, or by winding a string around the surface of the covering layer and fixing the string on the surface with the solution of adhesive agent.

In the present invention, the inflatable tube is protected by the covering layer, the reinforced layer, and the outer layer, which are located exterior to the tube.

The tube is covered with the covering layer which consists of a very thin rubber pouch which is made of the material which does not permit the solution of the adhesive agent to diffuse through the pouch, so that adhesion between the tube and the covering layer is prevented. Therefore, the tube is spaced from the covering layer.

Further, because of a spacing between the tube and the covering layer, a thin layer of air is formed between the tube and the covering layer. Elasticity of this layer in addition to that of the air filled in the tube, allows high softness and desirable elasticity of the ball.

Thus, because of the spacing between the tube and the covering layer, shocks from the outside are absorbed and relieved by synergism of the air layer which is formed between the tube and the covering layer, and the air which is filled in the tube. Therefore, the force exerted on a human body impacted by the ball of the invention is reduced by about one-third, and the touch of the ball becomes softer, so that the properties of the ball are improved.

Further, because of the existence of the inorganic lubricant between the tube and the covering layer, a sliding motion is caused between the tube and the covering layer when the ball receives a shock from the outside. Therefore, the shock is reduced by this sliding motion, and the durability of the ball is improved.

Furthermore, a powder of the inorganic lubricant is injected into the covering layer which consists of the very thin rubber pouch which is made of the material which does not permit the solution of the adhesive agent to diffuse through the pouch, or powder or the suspension of the inorganic lubricant is spread on the tube and the tube is inserted into the covering layer. Thus, the solution of the adhesive agent does not enter into the space between the tube and the covering layer, so the tube is spaced relative to the covering layer and a ball which has a tube which is slidable along the covering layer may be obtained. Therefore, a sports ball which has high performance may be produced with simple steps.

Accordingly, the sports ball may be produced by this production method with high efficiency compared to the prior production methods, and this method may be used as an effective method for reducing the cost of mass production.

DESCRIPTION OF THE PREFERRED EMBODIMENT

Figure 1:
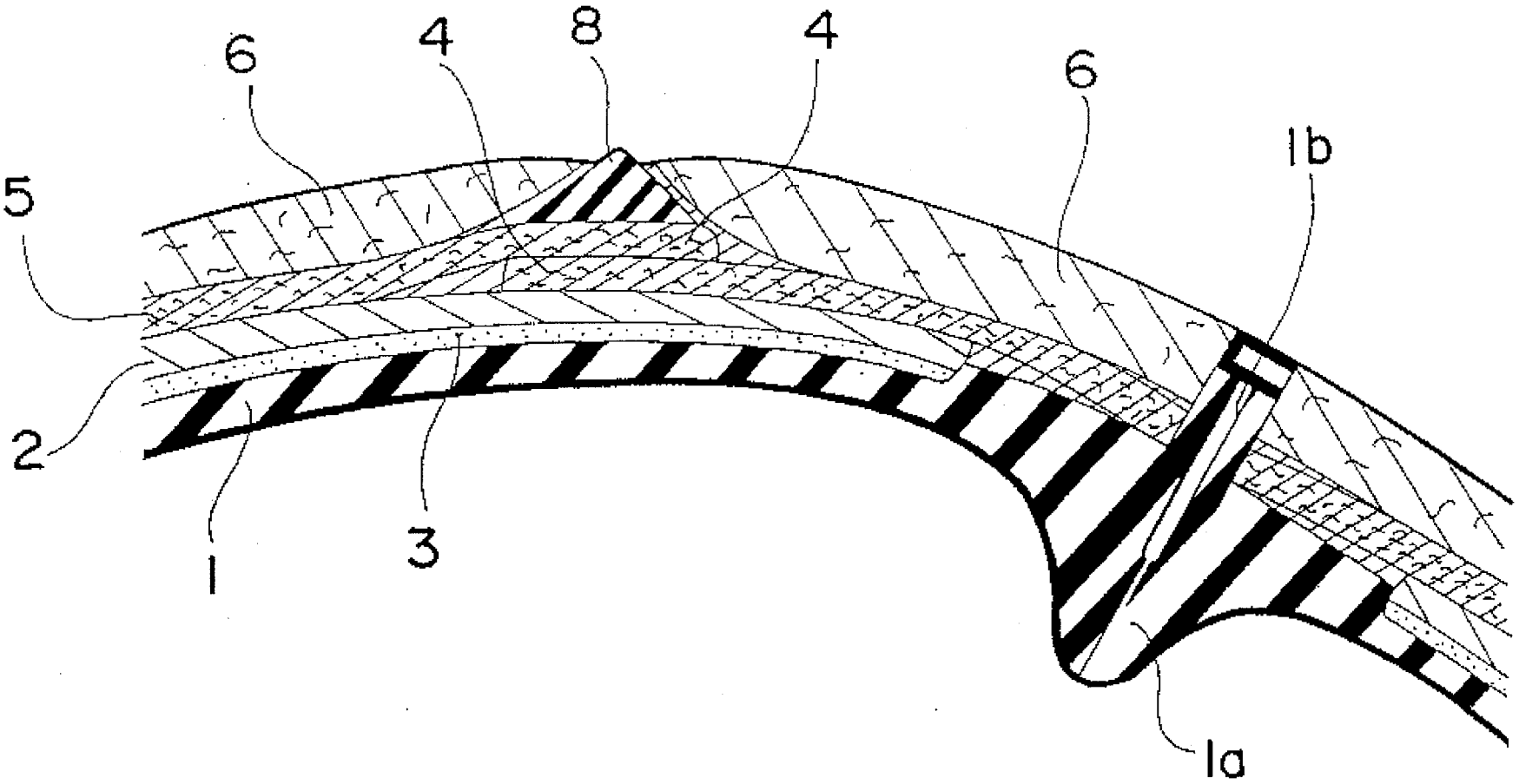
FIG. 1 is a partial cross-sectional view of the ball of the first embodiment of the present invention.
Figure 2:
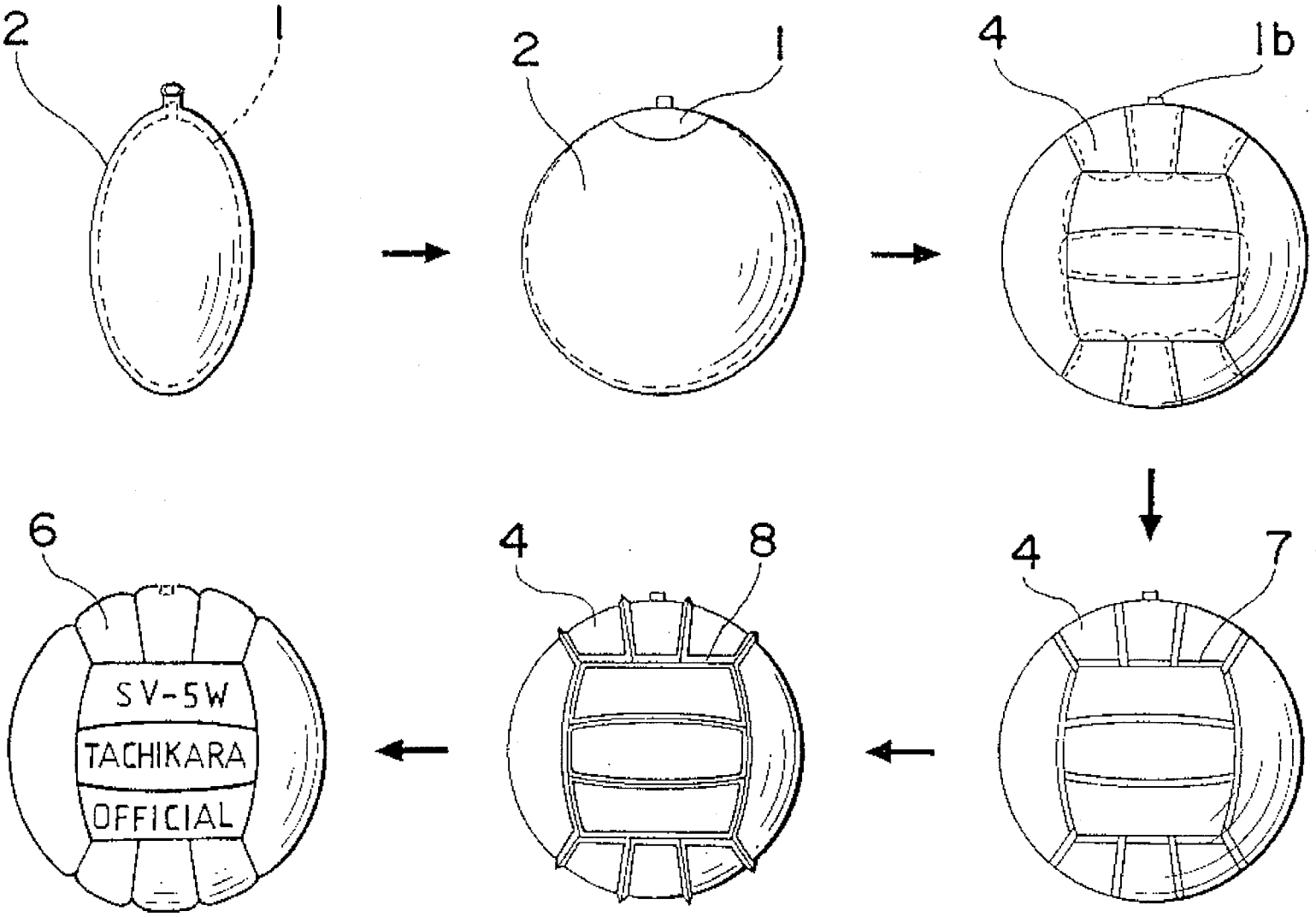
FIG. 2 is an operation chart for producing the ball of the first embodiment of the present invention.
Figure 3:
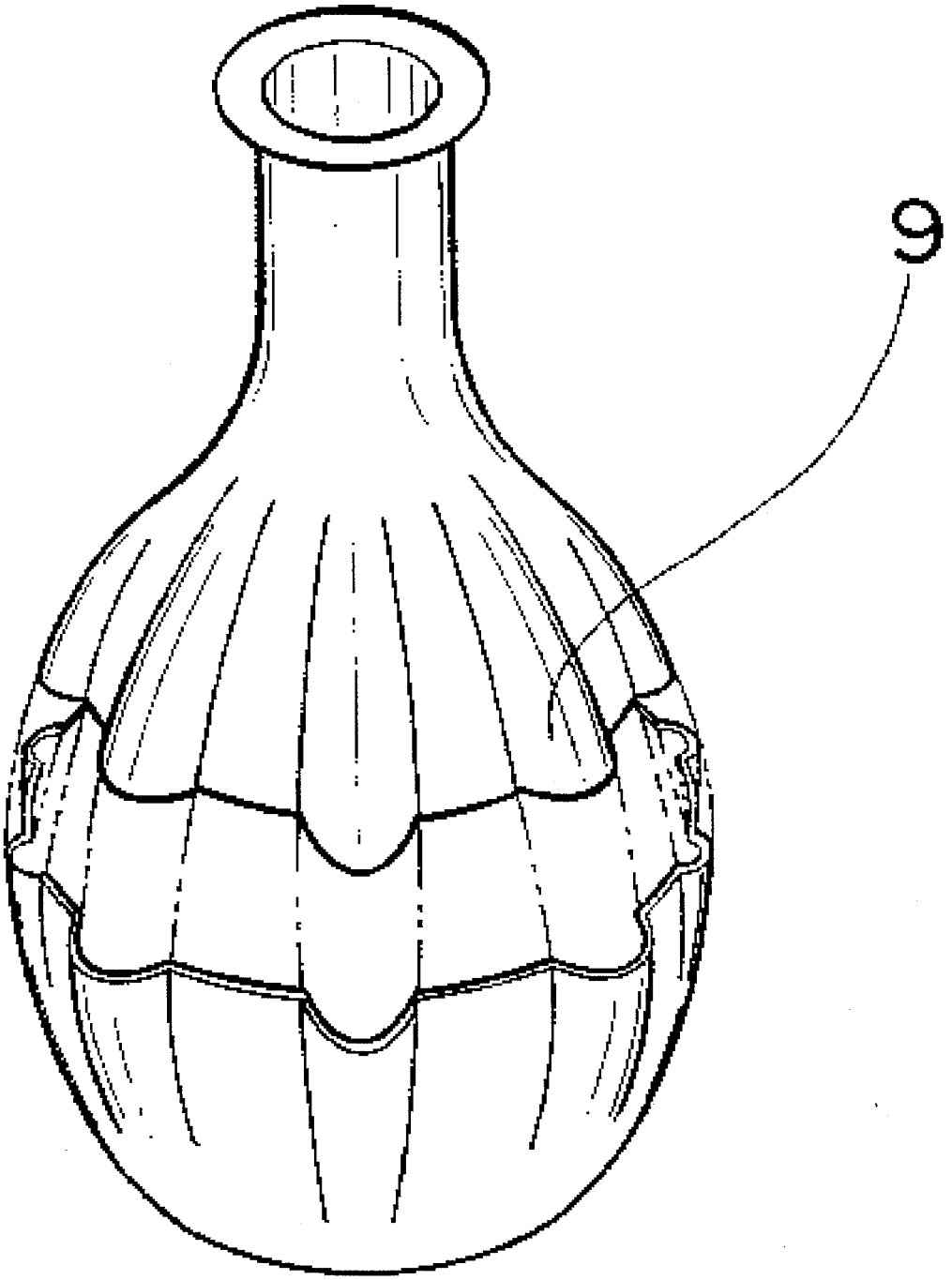
FIG. 3 is an oblique view of the very thin rubber pouch which consists of the covering layer of the second embodiment of the present invention.

In the following description, a first embodiment of the present invention will be described with references to the drawings. In FIGS. 1 and 2, an inflatable tube 1 is molded from rubber mainly composed of butyl rubber and is formed into a hollow sphere, and a valve la is disposed in one end of the tube 1. The tube 1 is made so that it is inflatable to a sphere of 186 mm in diameter when a predetermined quantity of air is blown into the tube 1 through the valve opening 1*b* to an internal pressure such that the material of the tube 1 itself is not stretched.

A covering layer 2 is a very thin rubber pouch mainly composed of natural rubber latex, and shaped like a rubber balloon. The covering layer is made so that it inflates to a sphere of 80 mm in diameter when a predetermined quantity of air is blown into the covering layer 2 to an internal pressure such that the material of the covering layer 2 itself is not stretched. The material which is employed as the covering layer 2 has the following properties: high extensibility, low stress so that a 100% extension is 3 kg per square centimeter, light weight, and 0.5 am thickness to avoid rupture during use.

The material which is used for the very thin rubber pouch preferably has the following properties: low stress so that a 100% extension is under 5 kg per square centimeter, and 0.2 mm –0.8 mm thickness to avoid rupture during use. However, there are no other limitations to the material, so long as the material is made of a material which does not permit the solution of an adhesive agent, such as an aqueous solution of latex or a solution of an adhesive agent which contains rubber, to diffuse through the pouch.

Next, a surface of the tube 1 is smeared with the powder of inorganic lubricant 3 when the tube 1 is not inflated. This tube 1 is inserted into the covering layer 2, and, a neck portion of the covering layer 2 is cut out to expose the valve 1a of the tube 1 from a surface of the covering layer 2. Subsequently, air is filled in the tube 1 through the valve opening 1*b*, and the tube 1 is inflated until the covering layer 2 is sufficiently inflated.

In this case, because of the existence of the inorganic lubricant 3 between the tube 1 and the covering layer 2, adhesion between the tube 1 and the covering layer 2 is prevented, and a sliding motion is caused between the tube 1 and the covering layer 2. Therefore, both the tube 1 and the covering layer 2 may inflate uniformly without any sticking.

Furthermore, the material having high expansivity, and low stress arising during extension, is employed as the material of the covering layer 2. Therefore, pressure from the covering layer 2 on the tube 1 is low when the covering layer 2 is sufficiently inflated. The tube 1 is thus protected by the covering layer 2.

Subsequently, a trapezoid shaped cotton cloth piece 4 is impregnated with an aqueous solution of latex which contains a vulcanizing agent, and the cloth piece 4 is attached on the surface of the covering layer 2. Natural or artificial latex also may be used as this latex, although the natural latex is superior in adhesion and elasticity. This latex solution is infiltrated into the interfiber spaces of the cloth piece 4, and produces caking on the cloth piece 4 as a reinforced layer 5 after drying and vulcanization as will be described later.

These cloth pieces 4 are strip shaped and are slightly longer in size than a strip formed by equatorial division of the covering layer 2 along the circumference of the covering layer 2 into eighteen parts, and are attached closely on the surface of the covering layer 2, by overlapping adjacent edges relative to each other.

Thus, the rubber material which composes the rubber pouch of the covering layer 2 does not permit an aqueous solution of latex to diffuse through the covering layer 2. Therefore, the solution of the adhesive agent does not enter into the space between the tube 1 and the covering layer 2, and adhesion between the tube 1 and the covering layer 2 is prevented.

Furthermore, the tube 1 which is covered by the covering layer 2 and the reinforced layer 5 is set into a flask for line drawing, and a line is drawn at the center of an overlapping portion of the adjacent cloth piece 4 of the reinforced layer 5, respectively. A rubber piece 7 shaped like a tape is adhered on the line.

Subsequently, the tube 1 is set into a flask which has a spherical shape inside, and the reinforced layer 5 is contacted to an inner surface of the flask by filling air into the tube 1, and the rubber piece 7 is hot vulcanized. A shallow groove is formed at a portion on an inner surface of the flask corresponding to the location at which the rubber piece 7 is contacted, respectively. After vulcanization, low rubber protruding bars are formed on the surface of the reinforced layer 5. These bars are used as alignment guides 8 for bonding outer layer 6 in the next step.

Because of the existence of the inorganic lubricant between the tube 1 and the covering layer 2, the adhesion of the tube 1 and the covering layer 2 which is caused by hot vulcanization is prevented; therefore, the space between the tube 1 and the covering layer 2 is maintained.

Lastly, eighteen pieces of strip-shaped outer layer 6 are adhered on the reinforced layer 5 respectively, along the alignment guides 8. This ball is heated to 60°–70° C. and pressed from the outside to finish forming the ball. A hole is opened at one of the eighteen outer layers 6 for air supply through the valve opening 1*b*.

The boundary portions of the outer layer 6 are strong because the alignment guides 8 are laminated on the overlap of cloth pieces 4. Thus, there is no fear of bursting the outer layer 6 at these boundary portions during use.

By forming the covering layer 2, reinforced layer 5, and outer layer 6, as described above, the strength of the ball is improved. Further, because of the existence of the inorganic lubricant between the tube 1 and the covering layer 2, sliding motion occurs between the tube 1 and the covering layer 2, and even if the ball receives a shock from the outside, this shock is reduced by this sliding motion and compression of the air in the tube 1 is prevented, thus, reducing the strain against the ball and improving the durability of the ball.

Furthermore, because of the existence of the space between the tube 1 and the covering layer 2, a thin layer of air is formed between then. The elasticity of this air layer in addition to that of the air filling in the tube 1 produces a high degree of softness and desirable elasticity of the ball.

In the above described first embodiment, the surface of the tube 1 is smeared with the inorganic lubricant and the tube 1 is inserted into the covering layer 2; additionally, the inorganic lubricant may be injected into the covering layer 2, or a suspension of inorganic lubricant such as a zinc stearate may be spread on the surface of tube 1. A neck portion of the covering layer 2 also may be cut out before the insertion of the tube 1.

Also in this embodiment, the covering layer 2 consists of the very thin rubber pouch which is made of the material which does not permit an aqueous solution of latex to diffuse through the pouch. The cloth piece 4 is attached to it with an aqueous solution of latex, although the adhesive agent is not limited to latex. Then, the covering layer 2 may consist of the very thin rubber pouch which is made of a material which does not permit the solution of an adhesive agent which contains rubber to diffuse through the covering layer 2, and the cloth piece 4 may be bonded to it with the solution of such adhesive agent, to prevent the adhesion of the tube 1 and the covering layer 2 and to form the space between the tube 1 and the covering layer 2.

Next, a second embodiment of the present invention will be described. A tube 1, previously smeared with a powder of mica, is inserted into a covering layer which is made of a material which does not permit a solution of an adhesive agent which contains rubber to diffuse through the covering layer, according to the same procedure as in the first embodiment. Subsequently, air is filled in the tube 1 to exert pressure upon the inside of the covering layer, and the tube and covering layer are inflated to a spherical shape.

The material employed as the covering layer of this embodiment has the following properties: high expansivity, a stress at 100% extension equal to 3 kg per square centimeter, and 0.3 mm thickness. This covering layer is formed to assume an oval shape with a 130 mm major axis and a 120 mm minor axis when filled with a certain quantity of air, such that the covering layer itself is not stretched.

The covering layer becomes spherical by the pressurization of the tube which takes a shape in accordance with the quantity of air filling the tube and the inflation along the circumference of the tube.

The very thin rubber pouch which forms the covering layer of this embodiment has slack portions 9 which run parallel to the vertical direction of its circumference, and because of the existence of the slack portions 9, air reservoirs are formed between the tube and the covering layer while the tube is inflated. Therefore, the existence of these air reservoirs and the inorganic lubricant causes a sliding motion between the tube and the covering layer more easily, and both the tube and the covering layer may inflate without any strain.

Subsequently, the reinforced layer is formed on the covering layer as a wound layer, by winding a string, of resorcin-formalin treated nylon 6,6 uniformly, using a friction type winding machine (see Japanese Patent Application, First Publication, Sho 56-13433) and applying an adhesive agent which contains rubber to the string.

Subsequently, the alignment guides are formed using the same steps as in the first embodiment, followed by adhesion of the outer layer, and a finished sports ball is produced.

The sports ball which is produced by the above steps has strength provided by forming the covering layer, reinforced layer, and outer layer, as in the first embodiment. Furthermore, because of the existence of the inorganic lubricant between the tube 1 and the covering layer 2, sliding motion takes place between the tube 1 and the covering layer 2, and when the ball receives the shock from the outside, this shock is reduced by this sliding motion, and the direct compression of the air in tube 1 is prevented. The strain on the ball is thereby relieved; therefore, the durability of the ball is improved.

In the second embodiment, the covering layer 2 consists of a very thin rubber pouch which is made of material which does not permit a solution of the adhesive agent which contains rubber to diffuse through the pouch, and the reinforced layer is wound on the covering layer by winding a string. However, the materials of these layers are not limited to those described above; the covering layer may consist of the very thin rubber pouch which is made of a material which does not permit an aqueous solution of latex to diffuse through the pouch. The reinforced layer also may be formed by winding a string uniformly and applying the adhesive agent which contains the solution of the adhesive agent to the string.

Furthermore, shape, size, and construction of the tube; the shape, size, composition, and construction of the covering layer; the size, composition, and construction of the reinforced layer; the composition of the adhesive agent; and the properties and composition of the inorganic lubricant are also not limited in the above embodiment.

The alignment guide is formed by forming the reinforced layer, drawing lines, adhering the tape-shaped rubber pieces along the lines, and hot vulcanizing of the rubber pieces in the flask. However, the method for forming the alignment guide is not limited to this process, and the alignment guide may also be forged by covering the surface of the reinforced layer with a rubber sheet and hot vulcanizing the rubber pieces in the flask.

As illustrated in the above description, the present invention provides a sports ball which is superior to conventional sports balls in properties such as strength, durability, softness, and elasticity, and the present invention allows the production of the sports ball with simple steps and on a large scale.

What is claimed is:

1. A sports ball comprising:

a hollow spherical shaped inflatable tube;

a rubber pouch around said inflatable tube forming a covering layer;

an inorganic lubricant between said tube and said covering layer;

a reinforced layer adhered on the outer surface of the covering layer with a solution of an adhesive agent wherein the covering layer is of a material which does not permit the solution of the adhesive agent to pass through the covering layer, and an outer layer on the outer surface of said reinforced layer.

2. The sports ball of claim 1, wherein said rubber pouch contains said inorganic lubricant to dispose the lubricant between said tube and said covering layer.

3. The sports ball of claim 1, wherein the surface of said inflatable tube has the inorganic lubricant spread thereon to dispose said inorganic lubricant between said tube and said covering layer.

4. The sports ball of claim 1, wherein the surface of said inflatable tube has a suspension of said inorganic lubricant spread thereover to dispose said inorganic lubricant between said tube and said covering layer.

5. The sports ball of claim 1, wherein said reinforced layer comprises cloth pieces attached on the surface of said covering layer by the solution of the adhesive agent.

6. The sports ball of claim 2, wherein said reinforced layer comprises cloth pieces attached on the surface of said covering layer by the solution of the adhesive agent.

7. The sports ball of claim 3, wherein said reinforced layer comprises cloth pieces attached on the surface of said covering layer by the solution of the adhesive agent.

8. The sports ball of claim 4, wherein said reinforced layer comprises cloth pieces attached on the surface of said covering layer by the solution of the adhesive agent.

9. The sports ball of claim 1, wherein said reinforced layer is a string wound on the surface of said covering layer and is fixed on said surface by the solution of the adhesive agent.

10. The sports ball of claim 2, wherein said reinforced layer is a string wound on the surface of said covering layer and is fixed on said surface by the solution of the adhesive agent.

11. The sports ball of claim 3, wherein said reinforced layer is a string wound on the surface of said covering layer and is fixed on said surface by the solution of the adhesive agent.

12. The sports ball of claim 4, wherein said reinforced layer is a string wound on the surface of said covering layer and is fixed on said surface by the solution of the adhesive agent.

* * * * *